US006010171A

United States Patent [19]

Margiottiello

[11] Patent Number: 6,010,171

[45] Date of Patent: Jan. 4, 2000

[54] APPARATUS FOR LIFTING OBJECTS HAVING A HOLLOW CYLINDRICAL CORE WITH REMOTE POWER-ACTUATED RELEASE

[75] Inventor: John Margiottiello, 3075-12th Avenue, Port Alberni, Canada, V9Y 1X2

[73] Assignee: John Margiottiello, Canada

[21] Appl. No.: 09/017,847

[22] Filed: Feb. 3, 1998

[51] Int. Cl.[7] ..... B66C 1/54

[52] U.S. Cl. ..... 294/94; 294/86.25; 294/905

[58] Field of Search ..... 294/93–97, 86.24, 294/86.25, 115, 116, 88, 905, 906, 82.3; 414/910, 911; 29/252

[56] References Cited

U.S. PATENT DOCUMENTS

| | | | |
|---|---|---|---|
| Re. 31,131 | 1/1983 | Torbet et al. . | |
| 2,507,577 | 5/1950 | Reynolds . | |
| 2,768,019 | 10/1956 | Brooks . | |
| 3,052,494 | 9/1962 | Williamson . | |
| 3,265,431 | 8/1966 | Burner | 294/95 |
| 3,485,388 | 12/1969 | Bohne . | |
| 3,905,636 | 9/1975 | Westerlund . | |
| 4,093,294 | 6/1978 | Taylor . | |
| 4,787,398 | 11/1988 | Lund . | |
| 5,138,754 | 8/1992 | Casteel et al. . | |
| 5,439,264 | 8/1995 | Margiottiello . | |

FOREIGN PATENT DOCUMENTS

| | | |
|---|---|---|
| 70950 | 2/1983 | European Pat. Off. . |
| 2169490 | 6/1990 | Japan . |
| 703474 | 12/1979 | U.S.S.R. . |
| 9006895 | 6/1990 | WIPO . |

*Primary Examiner*—Dean J. Kramer
*Attorney, Agent, or Firm*—Greer, Burns & Crain, Ltd.

[57] ABSTRACT

Prior lifting probes automatically release from the core of the paper roll as soon as the roll is placed on a surface and the lifting pressure from the cable is released. In some situations that can be undesirable, since some adjustment or juggling of the paper rolls may be required by the crane operator after the roll has first been placed on a surface. It is preferable that the release of the probe can be made remotely at the discretion of the operator to avoid the danger of a worker in close proximity to the cable, lifting probe and paper roll. The present invention provides a power-actuated cylinder to remotely release the lifting probe from the paper roll.

4 Claims, 5 Drawing Sheets

APPARATUS FOR LIFTING OBJECTS HAVING A HOLLOW CYLINDRICAL CORE WITH REMOTE POWER-ACTUATED RELEASE

TECHNICAL FIELD

The invention relates to devices for lifting, moving and handling paper rolls and similar massive articles having a central hollow cylindrical core, and more particularly to a lifting probe having a remote, power-actuated release.

BACKGROUND ART

Newsprint and similar materials are transported in large, massive rolls in which the sheet material is wound around a central cylindrical core of fibre or cardboard. Such objects are sufficiently heavy that they must be handled by crane for loading and unloading from vessels. They are readily damaged and so must be handled carefully in such loading and unloading. To facilitate loading and unloading such rolls, various core lifting chucks have been developed which have a probe which is inserted into the central cylindrical core of the roll and which grips the central core, to allow the roll to be lifted by a cable from a crane or the like.

The present inventor's U.S. Pat. No. 5,439,264 issued Aug. 8, 1995, entitled "Apparatus for Lifting Objects Having a Hollow Cylindrical Core" discloses a compact lifting probe which uses a single lifting cable attached to scissoring toggle arms, which can be readily removed from the roll core in case of jamming, is readily adjustable, and which is self-releasing when the load is to be released. It has a lower probe section which is inserted into the hollow core of the paper roll consisting of an inner component which is attached to a single lifting cable by means of the toggle arms, and an outer component which is attached to a horizontal plate against which the toggle arms act. When raised, the outer component is pressed downwardly. This causes a cone-shaped lower end of the inner component to force outwardly the ends of a number of pivoting fingers on the lower end of the outer component, which then engage and grip the inner core of the paper roll. When the roll is returned to the ground, the inner component drops back down, the fingers retract and the probe is removed from the core. Prior designs required two cables and two widely separated lifting arms, and so were cumbersome, heavy and unwieldy to operate, taking two persons to handle. The width of the two arms, which frequently swing around during the loading process, caused safety problems, and the two lines may become tangled.

One aspect of the present inventor's prior lifting probe is that it automatically releases from the core of the paper roll as soon as the roll is placed on a surface and the lifting pressure from the cable is released. In some situations that can be undesirable, since some adjustment or juggling of the paper rolls may be required by the crane operator after the roll has first been placed on a surface. It is preferable that the release of the probe can be made remotely at the discretion of the operator to avoid the danger of a worker in close proximity to the cable, lifting probe and paper roll. There is therefore a need for a lifting probe which can be released remotely from the paper roll.

DISCLOSURE OF INVENTION

The invention provides an apparatus for lifting objects having a vertically oriented, hollow cylindrical core, the apparatus of the type comprising a) means for connecting a hook or other lifting device; b) a face plate provided with a horizontal aperture; c) linkage means connecting the hook-connecting means to the face plate; d) a hollow sleeve dimensioned to be inserted into the core and comprising at the lower end thereof a plurality of jaw segments forming a diametrically expandable lower end; e) a transverse flange attached to the end of said sleeve having a diameter greater than that of the core; f) a latch assembly attached to the transverse flange and provided with a horizontally extending bolt biased to extend into the aperture in the face plate and handle means for releasably retracting the bolt means; h) a rod extending through the sleeve and having at the lower end thereof an outwardly tapered end; and i) spring means biasing the rod downwardly in the sleeve; wherein a power-actuated hydraulic or air cylinder is provided to secure the horizontally extending bolt in the core-engaging orientation until remotely released by the lift operator.

BRIEF DESCRIPTION OF DRAWINGS

In drawings which illustrate a preferred embodiment of the invention.

BEST MODE(S) FOR CARRYING OUT THE INVENTION

Figure 1:
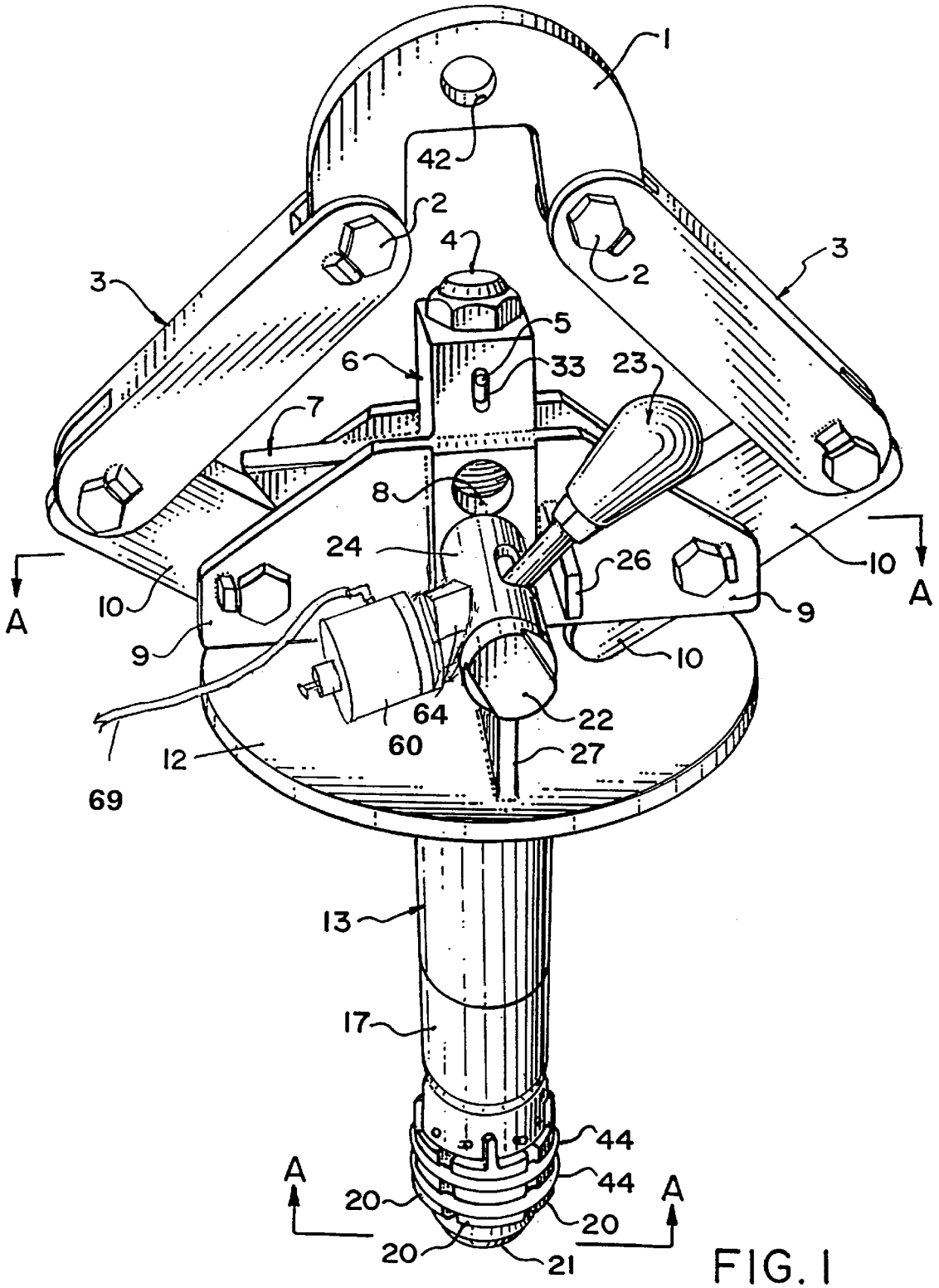
FIG. 1 is a perspective view from above of the probe of the invention.

With reference to the drawings, the lifting device of the invention is designated generally as 40. It has a horseshoe shaped plate 1 which is provided with hole 42 through which a hook or cable is inserted to lift the device. Two pairs of link plates 3 are pivotally attached to each arm of plate 1 by capscrew and nyloc nut assemblies 2. Toggle arms 10 are pivotally attached at one end thereof between each pair of link plates 3 and at the other end thereof between toggle assembly plates 9. Toggle assembly plates 9 are welded to threaded block 6 to which are also welded toggle stops 7 which limit the upward movement of the toggle arms 10. A latch assembly, described in further detail below, is mounted in the front of toggle assembly plate 9, and plate 9 is provided with hole 8 to receive the latch plunger 25 (FIG. 4) when the toggle arms are in the lowered position.

Forming the lower part of the device is a circular plate 12 provided with a central aperture in which is welded a hollow cylindrical sleeve 13. Expanding segments 20 are held by a segment holder 17 which is threaded into the lower end of sleeve 13. There will generally be four of the segments 20, which pivot outwardly on pin 18 and are provided with two ¼-inch rubber O-rings 44 in slots 46 which bias the segments inwardly and assist in the gripping function of the segments. Conical mandrel 21 is fixed to threaded block 48 which receives threaded drawbolt or "redi-rod" 14 which will typically be 1-inch diameter. An angle C for the mandrel 21 of 19 degrees has been found to be optimal. Drawbolt 14 is locked into block 48 by locking pin 16. A spring 15 is provided around the drawbolt 14 between shoulder 50 of block 48 and annular spacer 52 which is welded to the interior of sleeve 13. The upper end of drawbolt 14 passes through sleeve 11 and is threaded into threaded block 6. A lock pin 5 extends through slots 33 in either side of block 6 and through a slot in drawbolt 14 to prevent it from turning once it is in place. Nyloc nut 4 seals the upper end of the block 6. The typical length of the probe portion of the device (parts 13, 17, 20) is 16 inches, and the maximum width of the mechanism is about 33 inches.

Figure 4:
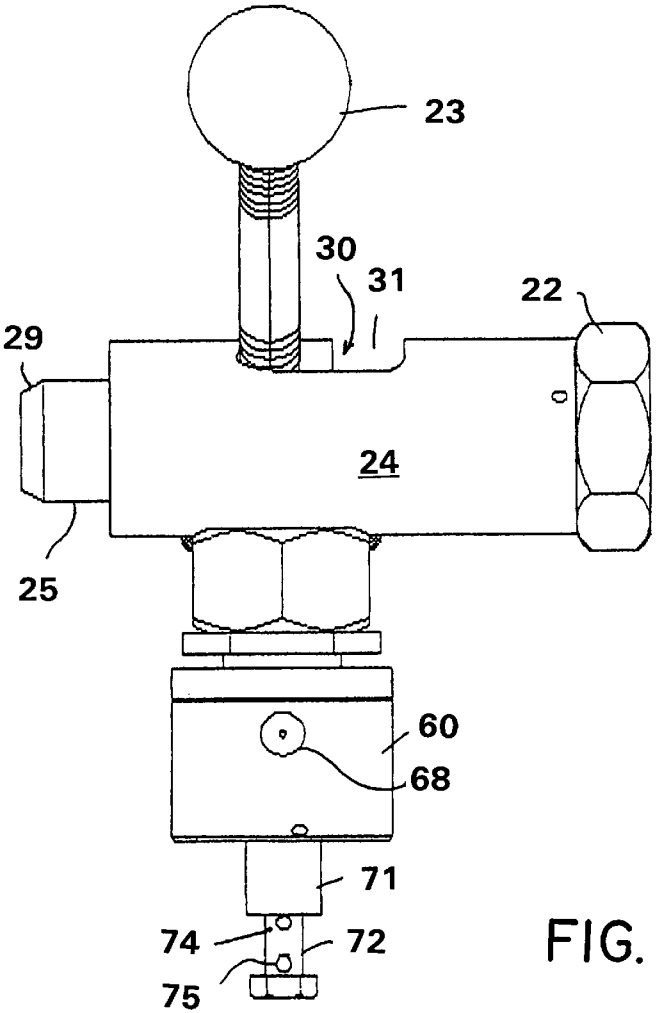
FIG. 4 is a front view of the latch portion shown in FIG. 3.
Figure 3:
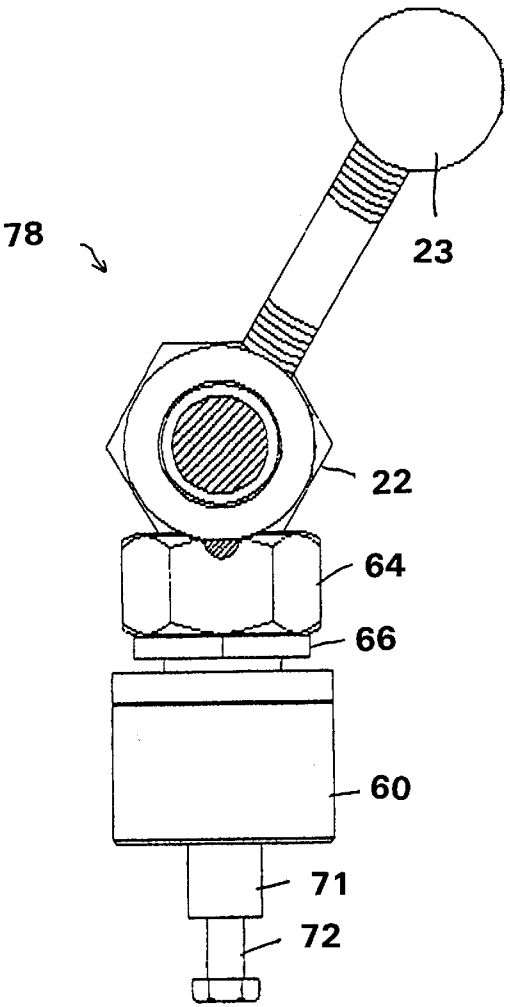
FIG. 3 is a front view of the latch portion of the probe illustrating the automatic release cylinder.
Figure 5:
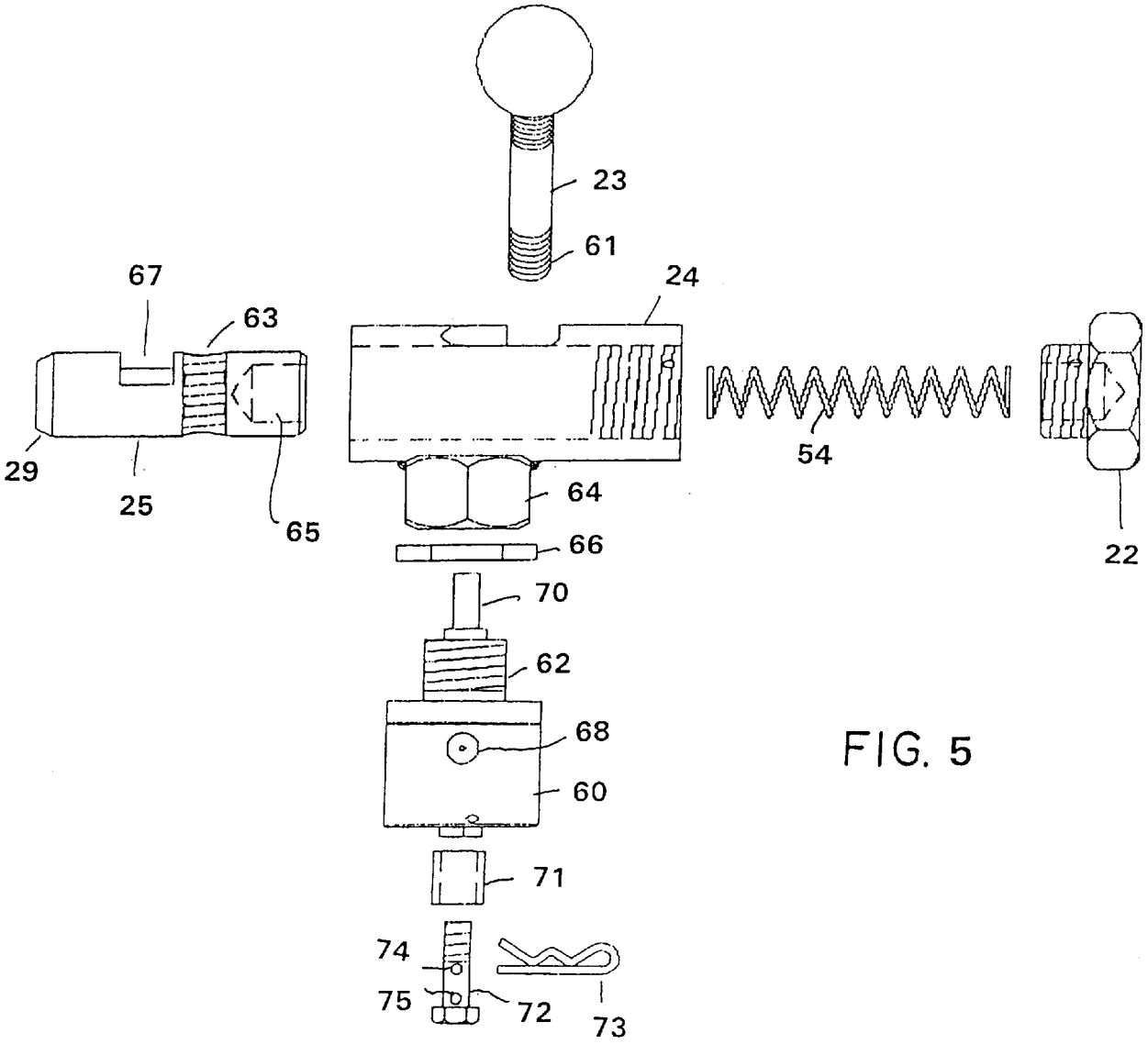
FIG. 5 is an exploded view, partly in cross section of the latch portion shown in FIG. 3.

Looking at FIGS. 3 through 5, latch assembly 78 consists of latch handle 23 (shown with a spherical end in FIG. 3 through 5), hollow cylindrical latch barrel 24, latch plunger 25 and latch cap 22 (shown as a hex nut in FIG. 3 through 5). The threaded end 61 of handle 23 is threaded into threaded hole 63 in latch plunger 25, shown in cross-section in FIG. 5. A spring 54 is provided within latch barrel 24 between cap 22 and cavity 65 of plunger 25 (shown in dotted outline in FIG. 5) to bias the plunger to the left in FIG. 4 and 5. Latch plunger 25 has a tapered end 29 and a notch 67. Latch barrel 24 has a slot 30 through which latch handle 23 extends, with notch 31. Latch barrel 24 is welded to a mounting plate 27 which is in turn welded to the top of circular plate 12. Trigger 26 is a horizontally extending bar welded at one end to the front of plate 9.

A pneumatic cylinder 60 is secured to latch barrel 24 by a threaded end 62 which is threaded, through washer 66, into connector nut 64 which is welded to latch barrel 24. Pneumatic cylinder 60 has a connector 68 for connecting an air hose 69 from a source of pressurized air. Pneumatic cylinder 60 operates a retractable pin 70 which is spring-biased to the extended position shown in FIG. 5, and which retracts when air pressure is applied to cylinder 60. When in the extended position, pin 70 extends into notch 67 when the notch 67 is aligned with it, to hold the latch plunger in place. When pin 70 is retracted by the air cylinder 60, latch plunger 25 can slide within latch barrel 24 without interference from pin 70. Pin 72 is threaded into the lower end of pin 70, through spacer 71 and allows pin 70 to be manually retracted and secured in a retracted position by cotter pin 73 inserted through hole 74. Cotter pin 73 can be stored in hole 75 when it is not desired to manually retract pin 70.

Figure 2:
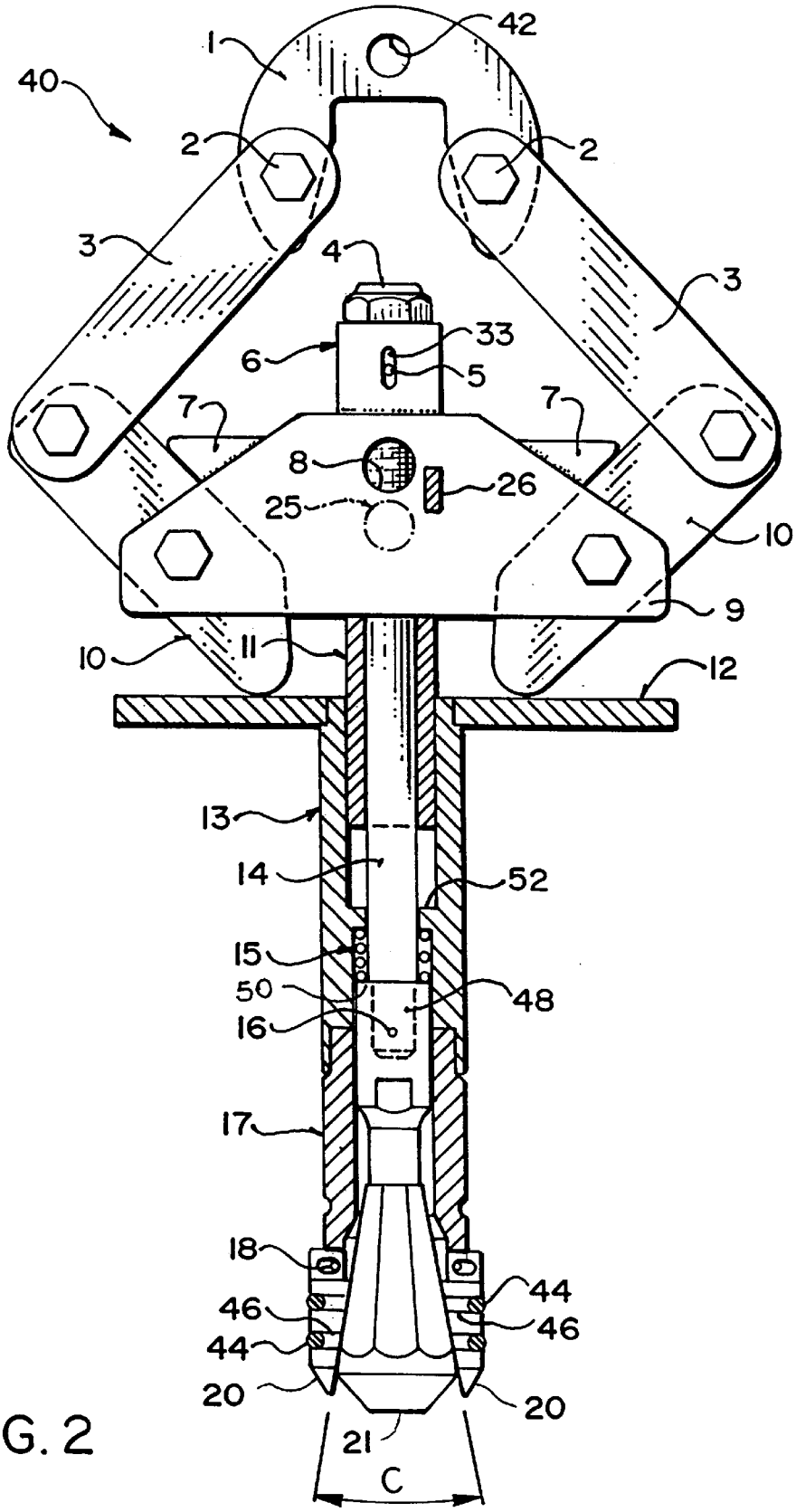
FIG. 2 is an elevation view, partly in cross section along line A—A of FIG. 1, of the probe of the invention with the toggle arms in raised position.

The latch assembly 78 permits an operator to remotely and automatically release the lifting mechanism from a roll after a roll has been lifted and placed on the ground. In the closed, non-lifting position, latch handle 23 is in the position shown in FIG. 4 with end 29 of the latch plunger 25 extending into hole 8 of plate 9. In this position the lifting mechanism 40 can be lifted by plate 1 into and out of the centres of rolls without gripping, since the toggle arms are held in the lowered position. When the mechanism 40 has been placed into a position for lifting a roll, latch handle 23 is pulled back until pin 70 extends into notch 67, thus removing and holding the end 29 of plunger 25 from hole 8. When the device is lifted from plate 1, plate 9 moves upwardly to the position shown in FIG. 2. This causes the ends 20 of the probe to expand and grip the core of the roll for lifting. When the mechanism 40 and attached roll are lowered to the ground, the plate 9 lowers until hole 8 is aligned with plunger 25. With the lifting force removed from plate 1, the operator can apply air pressure to cylinder 60, causing pin 70 to retract from notch 67 so that end 29 of plunger 25 is forced into hole 8. The mechanism 40 can then be lifted out of the roll with the toggle arms locked in the closed position. To operate the latching mechanism manually as disclosed in U.S. Pat. No. 5,439,264, in the event air pressure fails, for example, pin 72 is pulled back manually and secured in retracted position by cotter pin 73 through hole 74.

In operation, one or an array of mechanisms 40 are attached to the lifting cable of a crane or the like through hole 42. With the toggle arms latched in the lowered position, a worker can insert the probe into the central core of the paper roll, which has a diameter slightly greater than the diameter of sleeve 13 (for newsprint this is typically 3 inches, 4 inches for Kraft rolls). Once the plate 12 is lowered into contact with the roll, latch handles 23 are pulled back to put the mechanisms 40 into lifting mode. Lifting of the plate 1 now causes sleeve 11 and drawbolt 14 to be drawn upwardly with respect to sleeve 13, and mandrel 21 is similarly forced upwardly through segments 20, causing them to be forced or wedged outwardly into firm engagement with the inner surface of the core of the roll. The mechanical advantage provided by the camming action of toggle arms 10 against plate 12 greatly increases the force with which the outer surface of segments 21 and the related O-rings are driven against the inner core of the roll to ensure firm gripping. The roll can then be lifted and manipulated into place. When the operator is satisfied with the location, the lifting cable is lowered to remove the lifting pressure and lower the toggle arms, air pressure is supplied to cylinders 60 to release latch plungers 25, and the devices 40 are released from the cores of the rolls. Existing sources of air pressure, which use an accumulator which gradually builds up air pressure in the lines after the cylinders have been triggered, may be used, causing a short delay before the cylinders can be triggered again.

Figure 6:
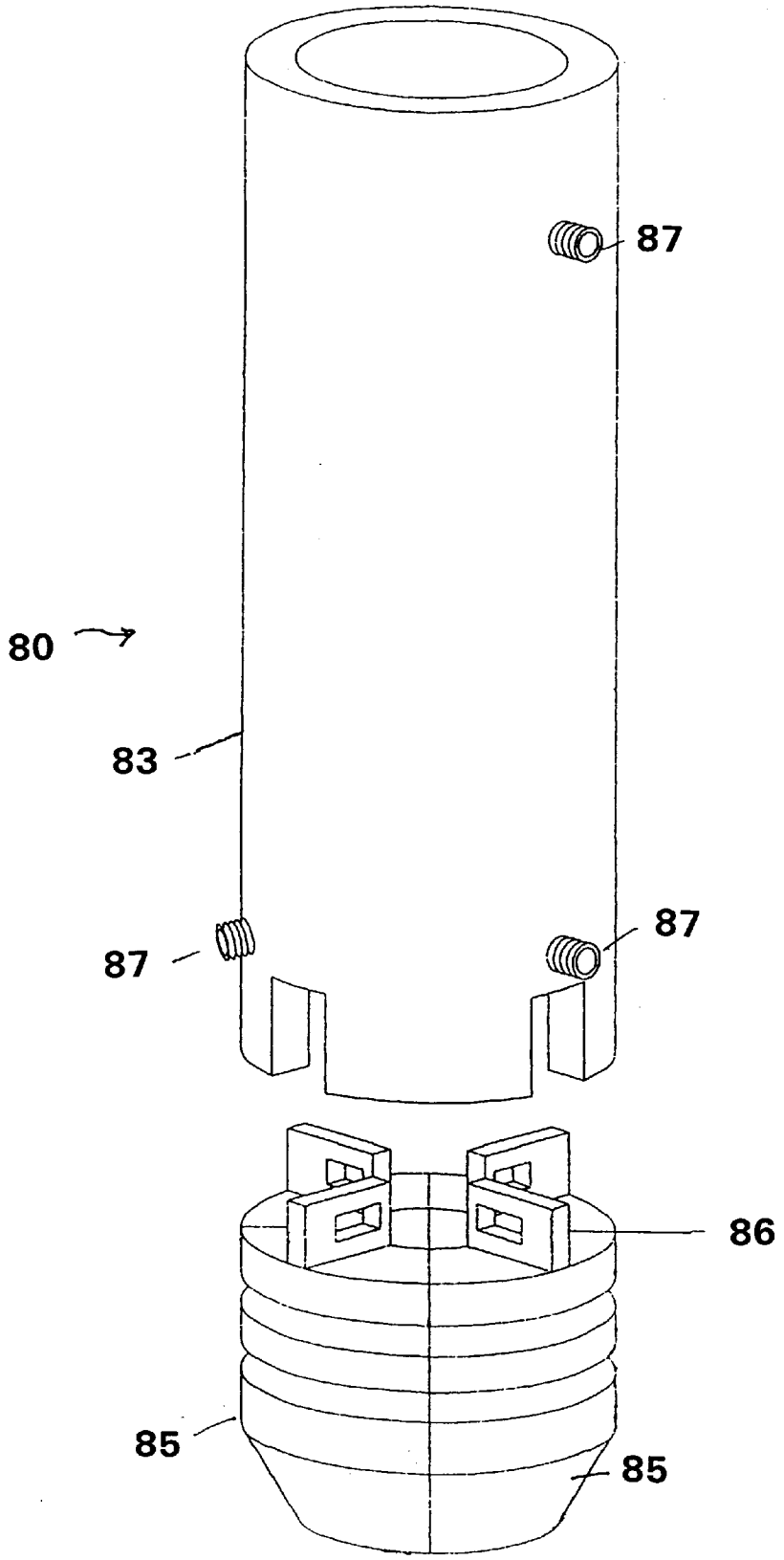
FIG. 6 is a perspective view from above of an adapter sleeve for use with the probe of the invention.

FIG. 6 illustrates a sleeve adapter 80 which allows the standard sleeve 13 used in 3-inch diameter cores, which sleeve is 2¾ inches in diameter, to be expanded for use in a 4-inch diameter core. Segments 20 are removed from pins 18 and sleeve 83, which is a cylinder 3¾ inches in outer diameter and 2¾ inches in inner diameter, is slid over sleeve 13. Four segments 85, which are similarly of greater diameter than segments 20, are then pinned on pins 18 through connectors 86, the O-rings 44 are replaced, and the device can be operated as before but in 4-inch diameter cores. Set screws 87 are provided to secure sleeve 83 to sleeve 13.

As will be apparent to those skilled in the art in the light of the foregoing disclosure, many alterations and modifications are possible in the practice of this invention without departing from the spirit or scope thereof. For example, while a pneumatic cylinder 60 has been described, a hydraulic cylinder would also function, as would a solenoid or other electro-mechanical device. Accordingly, the scope of the invention is to be construed in accordance with the substance defined by the following claims.

What is claimed is:

1. Apparatus for lifting objects having a vertically oriented, hollow cylindrical core comprising:

a) means for connecting a lifting device;

b) a vertically-extending plate having a front provided with a horizontal aperture;

c) linkage means connecting said means for connecting a lifting device to said vertically-extending plate;

d) a hollow sleeve having an upper end and a lower end and dimensioned to be inserted into said core and comprising at the lower end thereof a plurality of pivotable jaw segments forming a diametrically expandable lower end;

e) a transverse plate having an upper surface attached to the upper end of said sleeve, said transverse plate having a diameter greater than said core;

f) a latch assembly provided with a horizontally extending bolt biased to extend into said aperture in said vertically-extending plate when said vertically-extending plate is in a lowered position and handle means for releasably retracting said horizontally extending bolt from a first extended position into a second retracted position;

g) a rod extending through said hollow sleeve connected at the upper end thereof to said vertically-extending plate and having secured to the lower end thereof a mandrel having outwardly tapered sides adapted to engage said pivotable jaw segments;

h) spring means positioned in said hollow sleeve thereby biasing said rod downwardly in said hollow sleeve; and i) power-operated means for remotely and reversibly securing or releasing said horizontally-extending bolt.

2. The apparatus of claim 1 wherein said power-operated means for remotely and reversibly securing or releasing said horizontally-extending bolt comprises a power-actuated cylinder having a retractable pin adapted to engage or disengage from a notch in said bolt.

3. The apparatus of claim 2 wherein said power-operated means for remotely and reversibly securing or releasing said horizontally-extending bolt comprises a pneumatic cylinder having a pin which retracts upon the application of pressurized air to said cylinder.

4. The apparatus of claim 1 wherein said linkage means comprises two arms each pivotally connected at one end thereof to said means for connecting a linkage means, the other end thereof adapted to bear against the upper surface of said transverse plate, and each arm being pivotally connected to said vertically-extending plate at a point intermediate said first and second ends.

* * * * *